US011322079B2

(12) United States Patent
Wu

(10) Patent No.: US 11,322,079 B2
(45) Date of Patent: May 3, 2022

(54) DISPLAY CONTROL METHOD AND APPARATUS, DRIVING MODULE AND ELECTRONIC DEVICE

(71) Applicant: BEIJING XIAOMI MOBILE SOFTWARE CO., LTD., Beijing (CN)

(72) Inventor: Tsangchih Wu, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 16/931,631

(22) Filed: Jul. 17, 2020

(65) Prior Publication Data

US 2021/0272514 A1 Sep. 2, 2021

(30) Foreign Application Priority Data

Feb. 28, 2020 (CN) ..... 202010131493.8

(51) Int. Cl.
*G09G 3/3225* (2016.01)
*G09G 3/20* (2006.01)

(52) U.S. Cl.
CPC ..... *G09G 3/3225* (2013.01); *G09G 3/2092* (2013.01); *G09G 2310/06* (2013.01); *G09G 2310/08* (2013.01); *G09G 2360/121* (2013.01)

(58) Field of Classification Search
CPC .. G09G 3/2014; G09G 3/2018; G09G 3/2092; G09G 3/3225; G09G 2310/068; G09G 2320/064; G09G 2360/121
See application file for complete search history.

(56) References Cited

U.S. PATENT DOCUMENTS

2007/0018919 A1* 1/2007 Zavracky ..... G09G 3/3406 345/87
2007/0176883 A1* 8/2007 Hsu ..... G09G 3/342 345/102
2011/0074799 A1* 3/2011 Wu ..... H05B 45/37 345/532
2013/0155036 A1* 6/2013 Kim ..... G09G 3/2092 345/204
2014/0333673 A1* 11/2014 Cho ..... G09G 3/3406 345/660

(Continued)

FOREIGN PATENT DOCUMENTS

CN 109474768 A 3/2019
CN 110134034 * 8/2019
CN 110134034 A 8/2019

OTHER PUBLICATIONS

OA for EP application 20188888.0, dated Nov. 30, 2020.
OA for CN application 202010131493.8, dated Jan. 25, 2022.

*Primary Examiner* — Kenneth Bukowski
(74) *Attorney, Agent, or Firm* — Syncoda LLC; Feng Ma

(57) ABSTRACT

A display control method includes: obtaining a delay instruction from a processor, in which the delay instruction includes a delay duration required to display a current image frame; determining a plurality of control pulses required to display the current image frame according to the delay duration, in which duty cycles of the plurality of the control pulses are identical; and when a synchronization signal is received, generating each of the plurality of the control pulses sequentially, in which the control pulse is configured to control an active-matrix organic light-emitting diode (AMOLED) display for dimming and displaying.

12 Claims, 8 Drawing Sheets

(56) References Cited

U.S. PATENT DOCUMENTS

| | | | | |
|---|---|---|---|---|
| 2015/0371609 | A1* | 12/2015 | Choi | G09G 3/3648<br>345/205 |
| 2017/0039935 | A1* | 2/2017 | Yang | G09G 3/3233 |
| 2017/0301289 | A1* | 10/2017 | Jeong | G09G 3/3233 |
| 2018/0130408 | A1* | 5/2018 | Zhou | G09G 3/3225 |
| 2018/0151109 | A1* | 5/2018 | Shim | G09G 3/3233 |
| 2018/0151132 | A1 | 5/2018 | Lee et al. | |

* cited by examiner

DISPLAY CONTROL METHOD AND APPARATUS, DRIVING MODULE AND ELECTRONIC DEVICE

CROSS-REFERENCE TO RELATED APPLICATION

This application claims priority to Chinese Patent Application No. 202010131493.8 filed on Feb. 28, 2020, the disclosure of which is hereby incorporated by reference in its entirety.

BACKGROUND

An active-matrix organic light-emitting diode (AMOLED) display can be used as a display screen of an electronic device. The AMOLED display configured on the electronic device adopts pulse width modulation (PWM) for dimming at low brightness. This dimming mode generates an integer number (such as 4) of control pulses (EM) for each image frame, and adjusts the backlight of the display through a duty cycle of each control pulse.

SUMMARY

The present disclosure relates generally to a field of display technologies, and more specifically to a display control method and a display control apparatus, a driving module and an electronic device.

In a first aspect, the embodiments of the present disclosure provide a display control method applicable for an electronic device having an AMOLED display, in which the electronic device includes a processor and the AMOLED display, and the method includes: obtaining a delay instruction from the processor, in which the delay instruction includes a delay duration required to display a current image frame; determining a plurality of control pulses required to display the current image frame according to the delay duration, in which duty cycles of the plurality of the control pulses are identical; and when a synchronization signal is received, generating each of the plurality of the control pulses sequentially, in which the control pulse is configured to control the AMOLED display for dimming and displaying.

In a second aspect, the embodiments of the present disclosure provide a display control apparatus applicable for an electronic device having an AMOLED display, in which the electronic device includes a processor and the AMOLED display, and the apparatus includes: a delay instruction obtaining module, a control pulse obtaining module, and a control pulse generating module.

The delay instruction obtaining module is configured to obtain a delay instruction from the processor, in which the delay instruction includes a delay duration required to display a current image frame.

The control pulse obtaining module is configured to determine a plurality of control pulses required to display the current image frame according to the delay duration, in which duty cycles of the plurality of the control pulses are identical.

The control pulse generating module is configured to, when a synchronization signal is received, generate each of the plurality of the control pulses sequentially, in which the control pulse is configured to control the AMOLED display for dimming and displaying.

In a third aspect, the embodiments of the present disclosure provide a driving module applicable for an electronic device having an AMOLED display, in which the driving module includes a communication component, a cache component, a processing component, and a pulse generating component.

The communication component is configured to obtain image frame data to be displayed and a delay instruction.

The cache component is configured to cache the image frame data.

The processing component is configured to determine a plurality of control pulses required for displaying a current image frame according to a delay duration, in which the duty cycles of the plurality of the control pulses are identical.

The pulse generating component is configured to sequentially generate each of the plurality of the control pulses when receiving a synchronization signal, in which the control pulse is configured to control the AMOLED display for dimming and displaying.

In a fourth aspect, the embodiments of the present disclosure provide an electronic device, including: a processor; a memory for storing programs executable by the processor, in which the processor is configured to execute computer programs in the memory to obtain an image frame to be processed, to obtain a target duration for processing the image frame, and when the target duration is longer than a preset duration, to generate a delay instruction; and an AMOLED display of the driving module according to embodiments of the third aspect, in which the cache component is further configured to store computer programs executable by a processing component.

The processing component is configured to execute the computer programs in the cache component to obtain the delay instruction from a processor, in which the delay instruction includes a delay duration required to display a current image frame; determine a plurality of control pulses required to display the current image frame, a duration and a duty cycle of each control pulse according to the delay duration; and when a synchronization signal is received, based on the duration and the duty cycle of each control pulse, generate each of the plurality of the control pulses sequentially until the target number of control pulses are generated, in which the control pulse is configured to control the AMOLED display for dimming and displaying.

In a fifth aspect, the embodiments of the present disclosure provide a readable storage medium on which executable computer programs are stored, in which when the executable computer programs are executed, the method according to any one of embodiments of the first aspect is implemented.

It is understood that the above general description and the following detailed description are only exemplary and explanatory, and do not limit the present disclosure.

BRIEF DESCRIPTION OF THE DRAWINGS

The accompanying drawings, which are incorporated in and constitute a part of this disclosure, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

Figure 1:
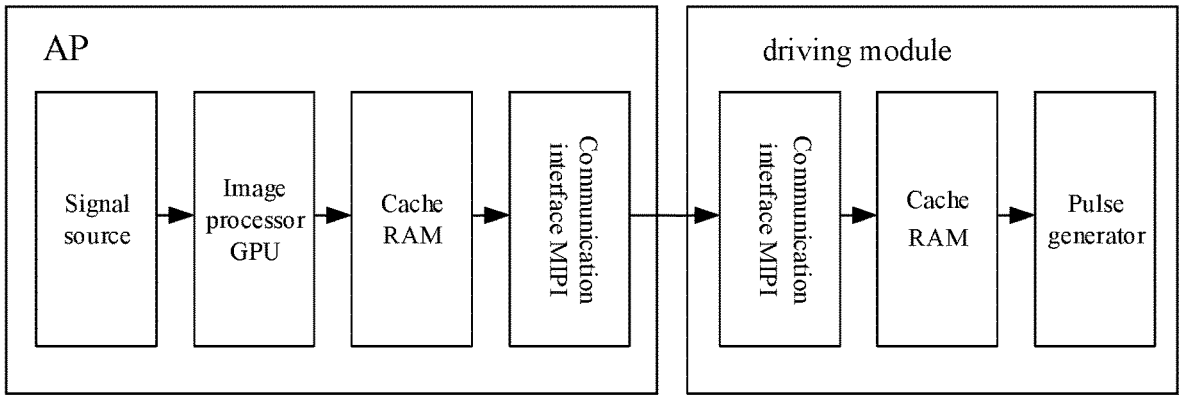
FIG. 1 is a block diagram of a driving module.
Figure 2:
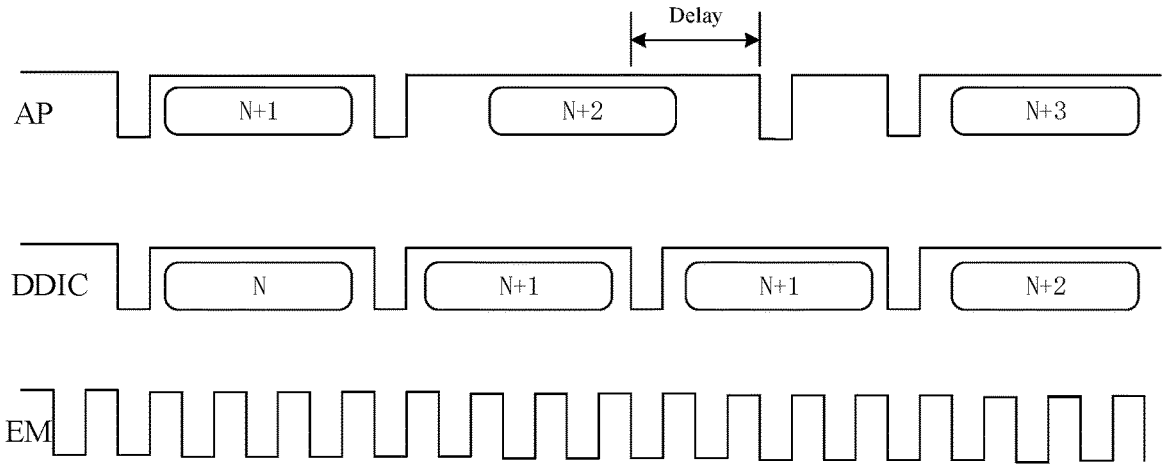
FIG. 2 is a timing diagram illustrating a scenario that the same frame data is transmitted in two adjacent refresh periods.

Combined with a structure of an electronic device shown in FIG. 1, when the processor (AP) processes information, there is often a situation where a large amount of data cannot be processed within a display duration of one image frame. Therefore, in some cases, the processor can only continue to process and transmit the information of the frame within a duration of a next frame. As the processor transmits the same information in two consecutive frames, as a timing sequence shown in FIG. 2, in this case, during the viewing process, the user may see stuttering in the display screen.

Figure 3:
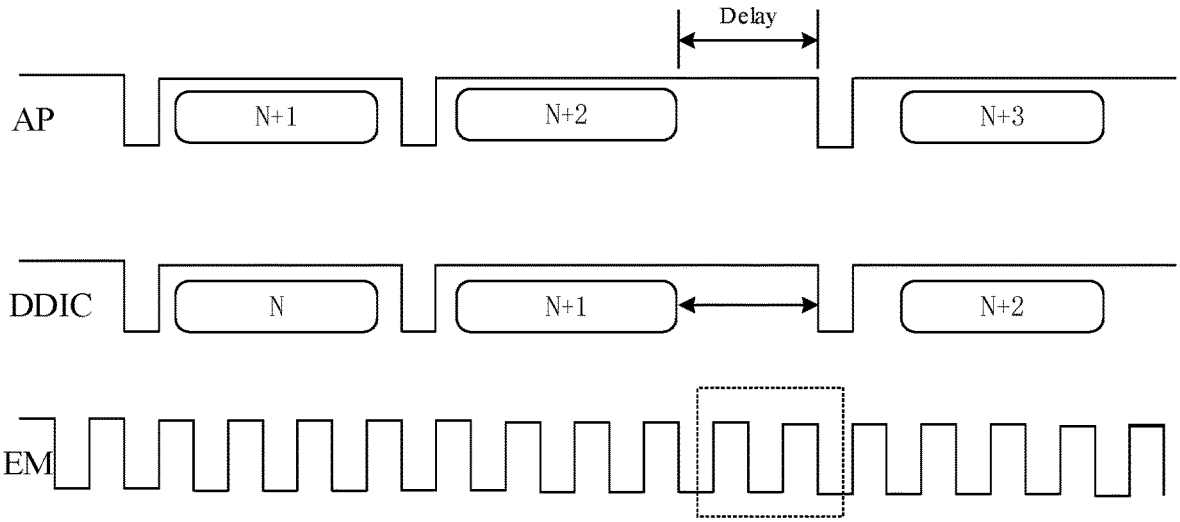
FIG. 3 is a timing diagram of a control pulse.

In this regard, a concept of Q-Sync can be proposed, which can automatically adjust a refresh rate of the display to match the GPU speed. For example, if the processor cannot process the information in one frame duration, the process is delayed for a certain period of time until the information is completely processed, and the time for transmitting the information of the next frame is postponed. The timing sequence is shown in FIG. 3. This method only needs to increase a required delay between the two frame durations. For example, if the processor only needs extra 1 ms to process the information, the next frame only needs to be delayed by 1 ms, and there is no need to transmit 2 frames of the same information.

Figure 4:
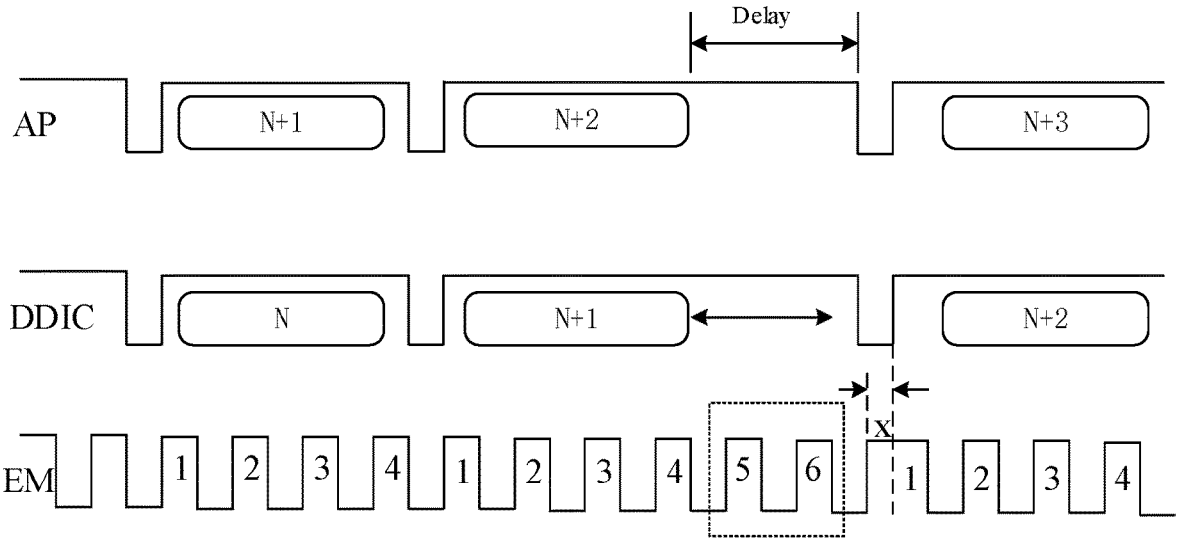
FIG. 4 is a timing diagram of another control pulse.

For the AMOLED display, when the processor needs a delay, at least one control pulse (EM) needs to be added, and a situation in which exactly two control pulses are added is shown in FIG. 3. However, in some scenes, the delay duration may exceed the duration of the integer number of control pulses, causing a change in the duty cycle of the control pulse, and resulting in a change in the brightness of the display and causing jitter in the display. Taking a sudden increase in the brightness as an example, as illustrated in FIG. 4, when the processor needs a delay, a driving module adds control pulses 5 and 6 on the basis of the control pulses 1-4. After the control pulse 6 changes from a high level to a low level, if the low-level stays for a preset duration, the control pulse will change from the low level to the high level, namely pulse X. When a synchronization signal arrives (changing from the low level to the high level), the control pulse is forcibly pulled to the high level, and the driving module generates the control pulse 1 within a refresh period N+2, which can be combined with the pulse X, the duty cycle of the control pulse becomes larger, and the display becomes suddenly brighter.

Figure 5:
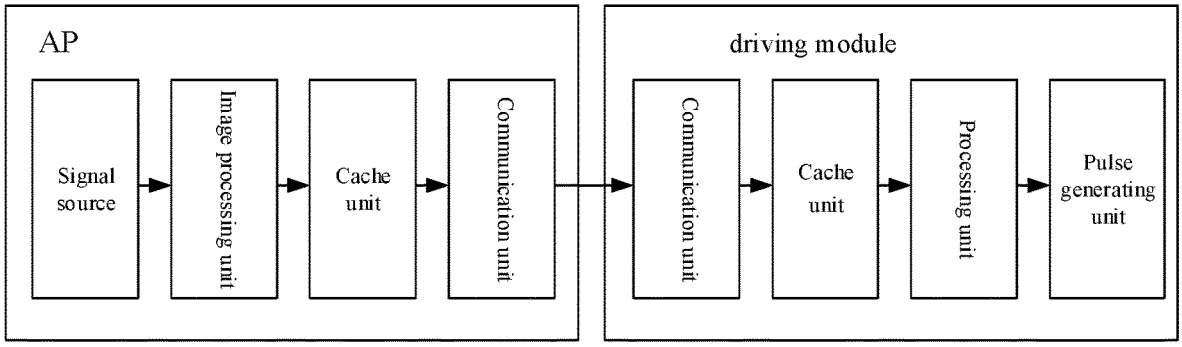
FIG. 5 is a block diagram of a driving module according to some embodiments.

In order to solve the problem of display jitter caused by a change in the brightness of the AMOLED display due to delay, embodiments of the present disclosure provide a display control method and a display control apparatus, a driving module, and an electronic device. FIG. 5 is a block diagram of a driving module according to some embodiments, as illustrated in FIG. 5, the driving module includes a communication component, a cache component, a processing component, and a pulse generating component.

The communication component is configured to obtain image frame data to be displayed and a delay instruction. Considering the subsequent calculation of a duty cycle of each control pulse, the communication component may further obtain a target brightness corresponding to the image frame to be displayed. The communication component may be implemented using a MIPI bus, and those skilled in the art may select a proper communication circuit or communication bus according to a specific scenario. In a case where multimedia data such as images or videos can be transmitted, the corresponding solution falls within the protection scope of the present disclosure.

The cache component is configured to cache the image frame data. The cache component may be implemented by a cache in the related art, which is not limited herein.

The processing component is configured to determine a plurality of control pulses required for displaying a current image frame according to a delay duration, in which the duty cycles of the plurality of the control pulses are identical. The processing component may be implemented by a hardware circuit or software, which is not limited herein.

The pulse generating component is configured to sequentially generate each control pulse of the plurality of the control pulses when receiving a synchronization signal, in which the control pulse is configured to control the AMOLED display for dimming and displaying.

Figure 6:
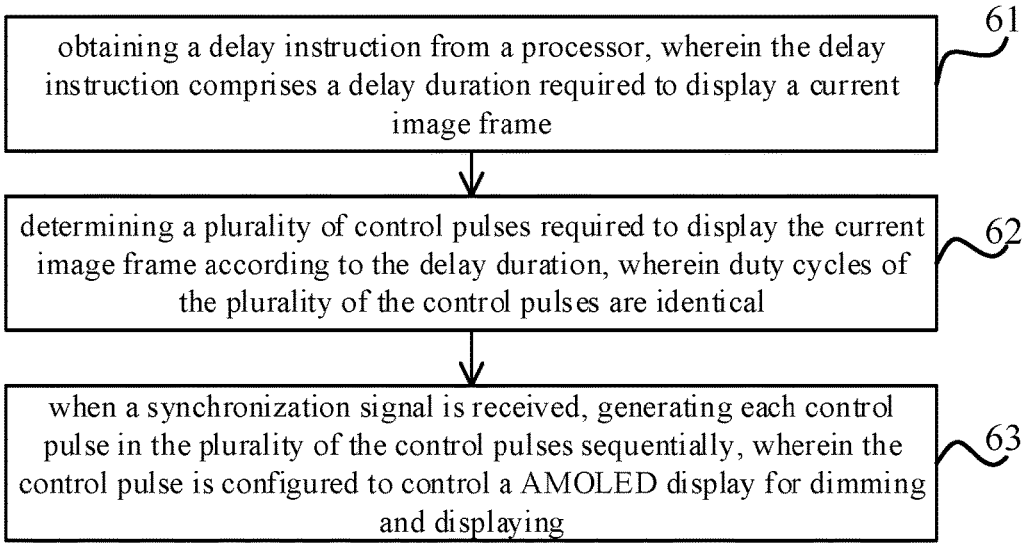
FIG. 6 is a flow chart of a display control method according to some embodiments.

Based on the above driving module, the embodiment of the present disclosure also provides a display control method. FIG. 6 is a flowchart of a display control method according to some embodiments. As illustrated in FIG. 6, the display control method includes steps 61, 62, and 63.

At step 61, a delay instruction is obtained from a processor, in which the delay instruction includes a delay duration required to display a current image frame.

In this embodiment, the driving module can obtain the delay instruction from the processor.

As illustrated in FIG. 5, the processor (AP) can obtain the image frame data of a signal source, process the image frame data, and obtain a target duration required for processing the image frame. Afterwards, the processor compares the target duration with a preset duration, and if the target duration is longer than the preset duration, the delay instruction is generated. The delay instruction includes the delay duration. The preset duration refers to a refresh period of the AMOLED display.

At step 62, a plurality of control pulses required to display the current image frame are determined according to the delay duration, in which duty cycles of the plurality of the control pulses are identical.

In the embodiments, the driving module may determine the plurality of the control pulses required to display the current image frame according to the delay duration.

Figure 7:
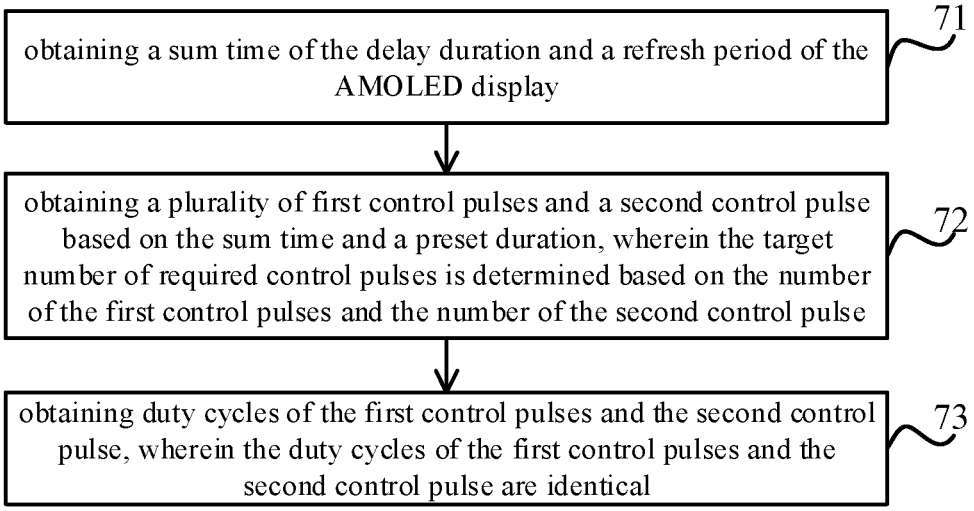
FIG. 7 is a flow chart of a process for acquiring control pulses according to some embodiments.

In an example, the AMOLED display has a certain refresh frequency corresponding to a refresh period. When the processor does not need a delay, the refresh period corresponds to a fixed number of control pulses. Taking the refresh frequency of 60 Hz as an example, the refresh period is about 16.7 ms. Based on the refresh period, as illustrated in FIG. 7, at step 71, the driving module may obtain a sum time of the delay duration and the refresh period of the AMOLED display, which is shown as T1 in FIG. 8. It is noted that the sum time is obtained by a driving module DDIC. In order to highlight a relation between the sum time and the delay duration, in this example, the sum time T1 is marked above the corresponding timing curve of the processor.

At step 72, the driving module obtains a plurality of first control pulses and one second control pulse based on the preset duration and the sum time. The number of the first control pulses and the number of the second control pulse are taken as the target number of required control pulses. The preset duration refers to a fixed duration set for the control pulse in advance. Taking the refresh period of 16.7 ms as an example, if 4 control pulses are set, the preset duration of each control pulse is about 4.2 ms. In addition, the first control pulse refers to a control pulse whose duration is the preset duration, and the second control pulse refers to a control pulse whose duration is shorter than the preset duration.

Figure 8:
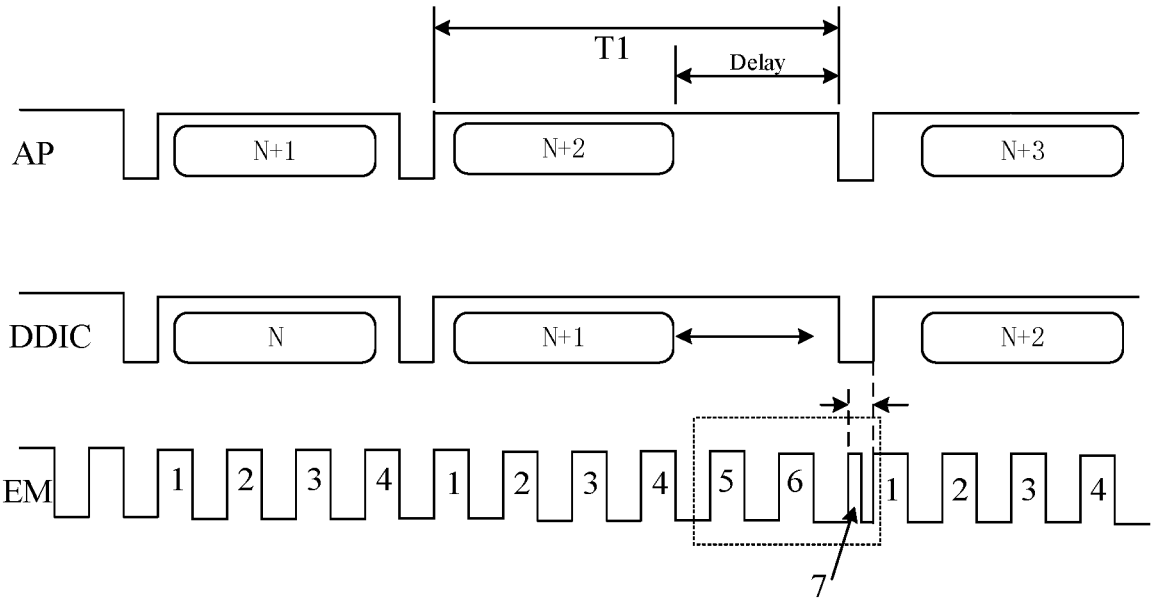
FIG. 8 is a timing diagram of control pulses according to some embodiments.

At step 73, the driving module may obtain the duty cycles of the first control pulses and the second control pulse according to a target brightness, and the duty cycles of the first control pulses and the second control pulse are identical, which is referred to the control pulse 7 in FIG. 8.

The target brightness may be obtained based on a light intensity of external ambient light in an environment where the electronic device is located, the light intensity is sensed by a light sensor in the electronic device and sent to the processor. Then, the processor obtains a display brightness of the AMOLED display according to the light intensity, and sends the display brightness as the target brightness to the driving module; or, the processor sends the above light intensity as the target brightness to the driving module, which may be selected by those skilled in the art according to specific scenarios and is not limited herein.

As illustrated in FIG. 8, after the control pulse 6 remains at a low level for the preset duration, the control pulse changes from the low level to the high level of the control pulse 7. Due to a limitation of the duty cycle, the high level remains for a certain period of time and turns into the low level, and the low level of the control pulse 7 is changed into the high level of the control pulse 1 in a next refresh period after a next synchronization pulse becomes a high level.

It is understandable that the duration of the second control pulse in this example is shorter than the preset duration, and the duty cycle of the second control pulse is identical to the duty cycle of the first control pulse, or that the second control pulse is obtained by scaling down the first control pulse, which has the following benefits. First, the control pulse is matched with each delay duration, that is, any delay duration can be obtained by means of an integer number of the first control pulses and one second control pulse. Second, the synchronization match between the refresh period with increased delay and its next refresh period is achieved, that is, by setting the second control pulse, the processor and the driving module are synchronized, and the first control pulse in the next refresh period remains intact.

In a PWM dimming mode, since the duty cycles are identical, the display brightness of the AMOLED display corresponding to the second control pulse is identical to the display brightness of the AMOLED display corresponding to the first control pulse.

Figure 9:
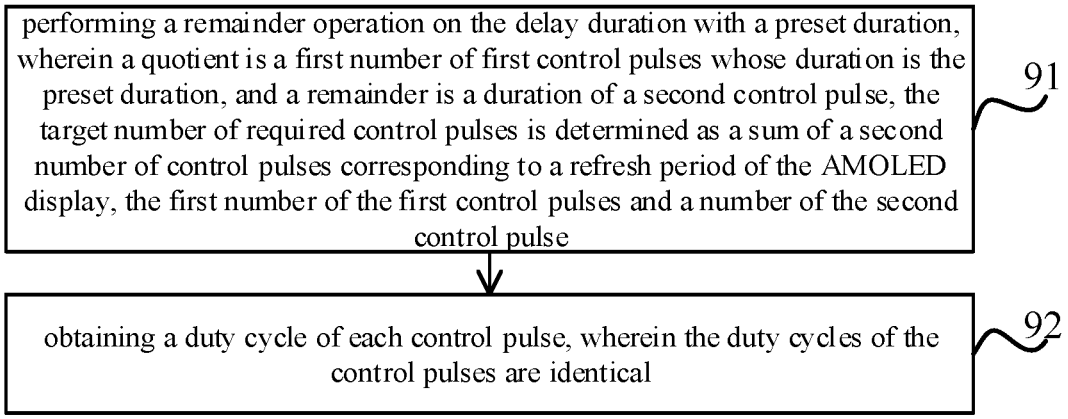
FIG. 9 is a flowchart of another process for acquiring control pulses according to some embodiments.

In another example, as illustrated in FIG. 9, at step 91, the driving module may perform a remainder operation on the delay duration with the preset duration. The quotient is the first number of the first control pulses whose time duration is the preset duration. The remainder is the duration of the second control pulse. The target number of the required control pulses is determined as a sum of the second number of control pulses corresponding to the refresh period of the AMOLED display, the first number of the first control pulses, and the number of the second control pulse, while the preset duration refers to a fixed duration previously set for the control pulse.

It is noted that the solution of step 91 is essentially to add the first number of the first control pulses and one second control pulse on the basis of the second number of control pulses corresponding to the refresh period. As illustrated in FIG. 8, that is, on the basis of the control pulses 1-4, the first control pulses 5 and 6 and the second control pulse 7 are added. It is noted that the delay duration in the embodiments illustrated in FIGS. 7 and 9 does not include the duration of a following synchronization pulse. In practical applications, the delay duration may include the duration of the following synchronization pulse, which is beneficial to improve the accuracy of the acquired second control pulse.

At step 92, the driving module may obtain the duty cycle of each control pulse according to the target brightness, and the duty cycles are identical.

In this embodiment, a corresponding relation table between the target brightness and the duty cycle can be preset in the driving module, so that the driving module can obtain the duty cycle of each control pulse after acquiring the target brightness. Since the duty cycles of control pulses in each refresh period is the same, the order of step 92 and step 91 may not be limited.

At step 63, when a synchronization signal is received, each control pulse in the plurality of the control pulses is generated sequentially, in which the control pulse is configured to control an AMOLED display for dimming and displaying.

In this embodiment, when the synchronization signal is received, the driving module sequentially generates each of the plurality of the control pulses. The duration of the last control pulse in a current refresh period is shorter than the duration of each previous control pulse. It is understandable that the AMOLED display (an array substrate configured within the AMOLED display) may control each OLED to be turned on or off, and an effect of adjusting the display brightness of the AMOLED display to the target brightness when displaying the current image frame is achieved.

According to the above embodiments, a delay instruction is obtained from a processor, in which the delay instruction includes a delay duration required to display a current image frame, a plurality of control pulses required to display the current image frame are determined according to the delay duration, in which duty cycles of the plurality of the control pulses are identical. When a synchronization signal is received, each control pulse in the plurality of the control pulses is generated sequentially, in which the control pulse is configured to control an AMOLED display for dimming and displaying. In this embodiment, the duty cycles of the plurality of the control pulses in a refresh period are identical, which ensures that the brightness of the AMOLED display remains unchanged and avoids jittering of the display image, thus viewing experience is improved.

Figure 10:
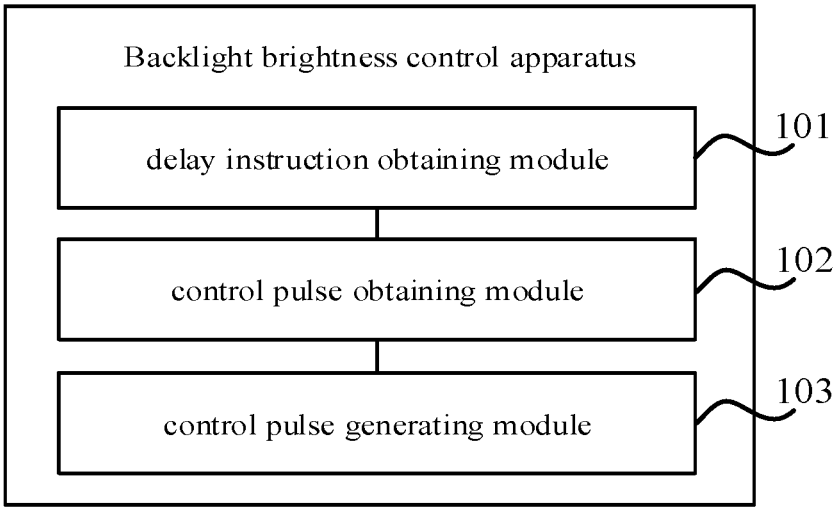
FIG. 10 is a first block diagram of a display control apparatus according to some embodiments.

FIG. 10 is a block diagram of a display control apparatus according to some embodiments. As illustrated in FIG. 10, a display control apparatus applicable for an electronic device having an AMOLED display is provided, in which the electronic device includes a processor and the AMOLED display, and the apparatus includes: a delay instruction obtaining module 101, a control pulse obtaining module 102, and a control pulse generating module 103.

The delay instruction obtaining module 101 is configured to obtain a delay instruction from a processor, in which the delay instruction includes a delay duration required to display a current image frame.

The control pulse obtaining module 102 is configured to determine a plurality of control pulses required to display the current image frame according to the delay duration, in which duty cycles of the plurality of the control pulses are identical.

The control pulse generating module 103 is configured to, when a synchronization signal is received, generate each control pulse in the plurality of the control pulses sequentially, in which the control pulse is configured to control an AMOLED display for dimming and displaying.

Figure 11:
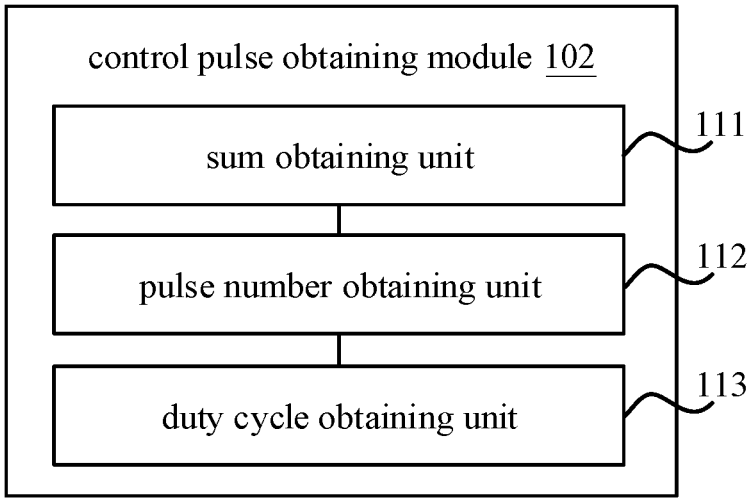
FIG. 11 is a second block diagram of a display control apparatus according to some embodiments.

In an embodiment, as illustrated in FIG. 11, the control pulse obtaining module 102 includes: a sum obtaining component 111, a pulse number obtaining component 112, and a duty cycle obtaining component 113.

The sum obtaining component 111 is configured to obtain a sum time of the delay duration and a refresh period of the AMOLED display.

The pulse number obtaining component 112 is configured to obtain a plurality of first control pulses and one a second control pulse based on the said sum time and a preset duration, in which the target number of the required control pulses is determined based on the number of the plurality of first control pulses and the number of the second control pulse, while the first control pulse refers to a control pulse whose duration is the preset duration, the second control pulse refers to a control pulse whose duration is shorter than the preset duration, and the preset duration refers to a fixed duration previously set for the control pulse.

The duty cycle obtaining component 113 is configured to obtain duty cycles of the plurality of first control pulses and the second control pulse according to a target brightness, in which the duty cycles of the plurality of first control pulses and the second control pulse are identical.

Figure 12:
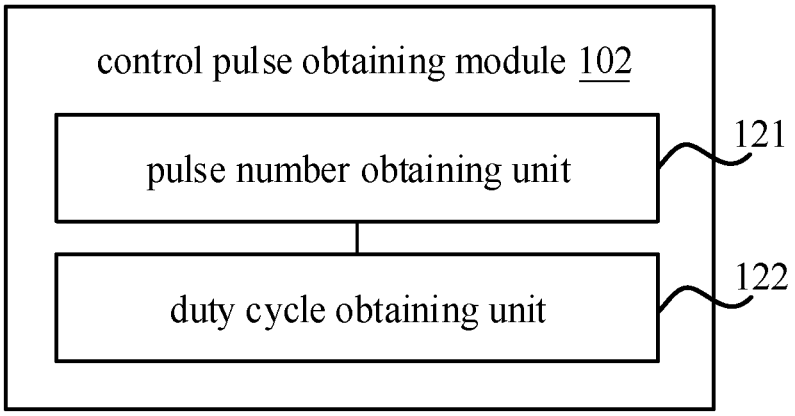
FIG. 12 is a third block diagram of a display control apparatus according to some embodiments.

In an embodiment, as illustrated in FIG. 12, the control pulse obtaining module 102 includes: a pulse number obtaining component 121 and a duty cycle obtaining component 122.

The pulse number obtaining component 121 is configured to perform a remainder operation on the delay duration with a preset duration, in which a quotient is a first number of first control pulses whose duration is the preset duration, and a remainder is a duration of the last control pulse, the target number of required control pulses is determined as a sum of the second number of control pulses corresponding to a refresh period of the AMOLED display, the first number of the first control pulses, and a number of the last control pulse, while the preset duration refers to a fixed duration previously set for the control pulse.

The duty cycle obtaining component 122 is configured to obtain duty cycle of each control pulse, in which the duty cycles of the control pulses are identical.

Figure 13:
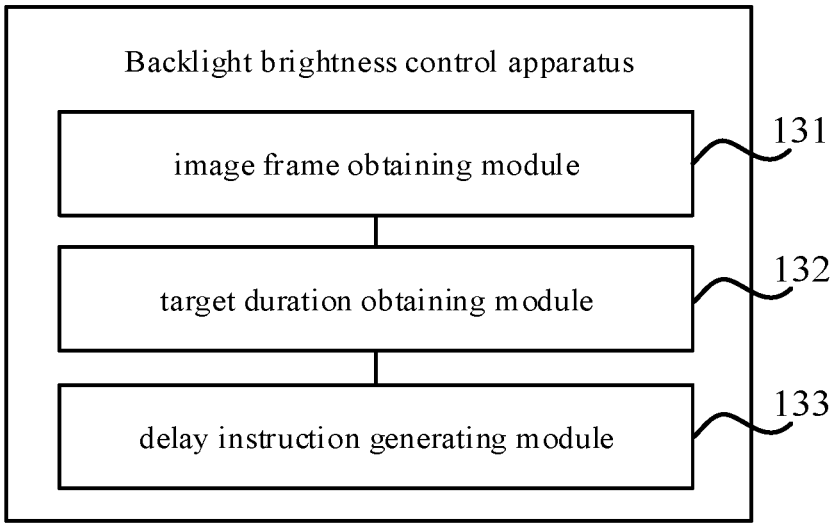
FIG. 13 is a fourth block diagram of a display control apparatus according to some embodiments.

In an embodiment, as illustrated in FIG. 13, the display control apparatus further includes: an image frame obtaining module 131, a target duration obtaining module 132, and a delay instruction generating module 133.

The image frame obtaining module 131 is configured to obtain an image frame to be processed.

The target duration obtaining module 132 is configured to obtain a target duration for processing the image frame.

The delay instruction generating module 133 is configured to, when the target duration is longer than the preset duration, generate a delay instruction.

It is understandable that the apparatus according to the embodiments of the present disclosure corresponds to the above method, and the specific content is referred to the content of each method embodiment, which is not repeated here.

Figure 14:
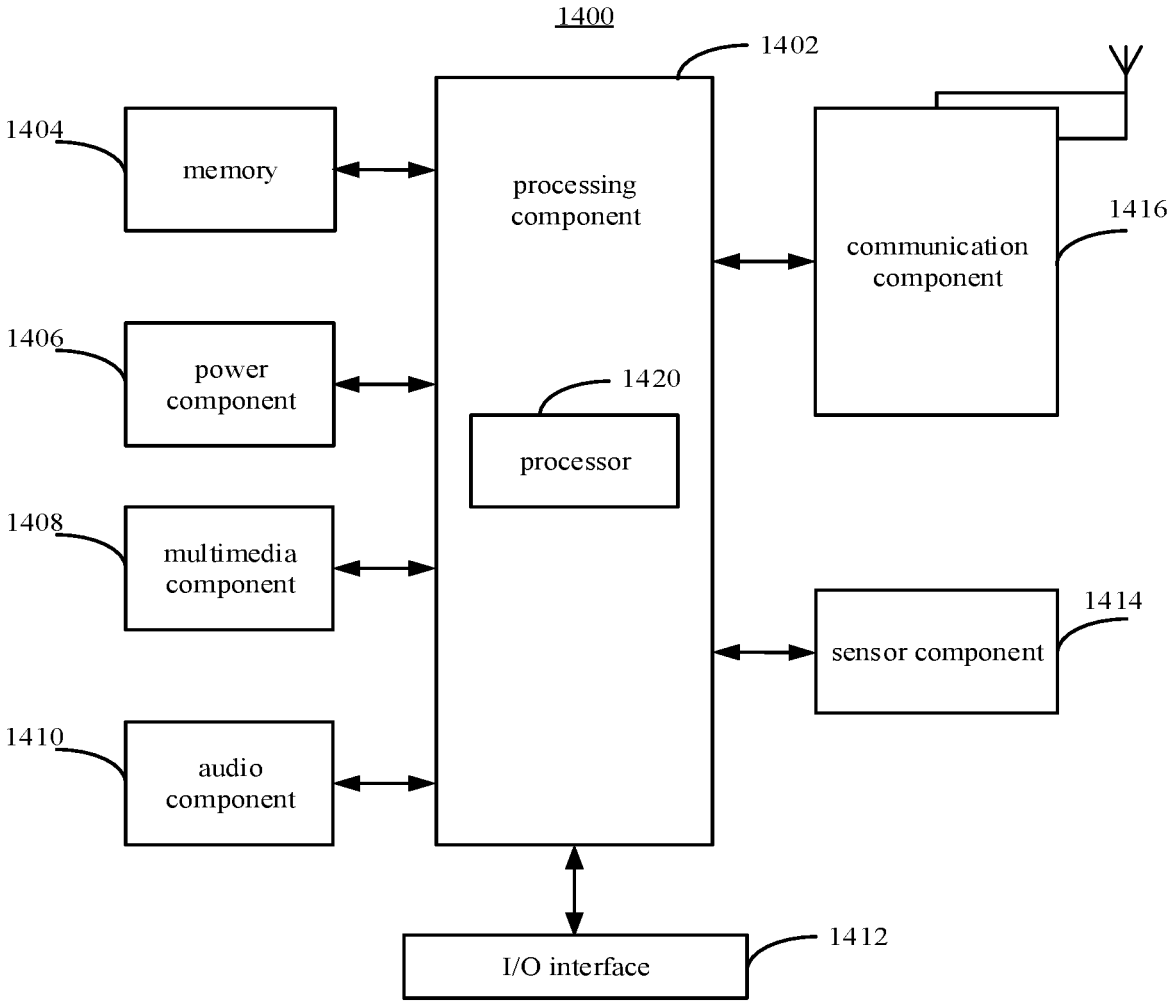
FIG. 14 is a block diagram of an electronic device according to some embodiments.

FIG. 14 is a block diagram of an electronic device according to some embodiments. For example, the electronic device 1400 may be a mobile phone, a computer, a digital broadcasting terminal, a tablet device, a medical device, a fitness device, and a personal digital assistant.

As illustrated in FIG. 14, the electronic device 1400 may include one or more of the following components: a processing component 1402, a memory 1404, a power component 1406, a multimedia component 1408, an audio component 1410, an input/output (I/O) interface 1412, a sensor component 1414, a communication component 1416, and an image acquisition module 1418.

The processing component 1402 typically controls overall operations of the electronic device 1400, such as the operations associated with display, telephone calls, data communications, camera operations, and recording operations. The processing component 1402 may include one or more processors 1420 to execute instructions to perform all or part of the steps in the above described methods. Moreover, the processing component 1402 may include one or more modules which facilitate the interaction between the processing component 1402 and other components. For instance, the processing component 1402 may include a multimedia module to facilitate the interaction between the multimedia component 1408 and the processing component 1402.

The memory 1404 is configured to store various types of data to support the operation of the electronic device 1400. Examples of such data include instructions for any applications or methods operated on the electronic device 1400, contact data, phonebook data, messages, pictures, video, etc. The memory 1404 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 1406 provides power to various components of the electronic device 1400. The power component 1406 may include a power management system, one or more power sources, and any other components associated with the generation, management, and distribution of power in the electronic device 1400.

The multimedia component 1408 includes a screen providing an output interface between the electronic device 1400 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action.

The audio component 1410 is configured to output and/or input audio signals. For example, the audio component 1410 includes a microphone ("MIC") configured to receive an external audio signal when the electronic device 1400 is in an operation mode, such as a call mode, a recording mode, and a voice recognition mode. The received audio signal may be further stored in the memory 1404 or transmitted via the communication component 1416. In some embodiments, the audio component 1410 further includes a speaker to output audio signals.

The I/O interface 1412 provides an interface between the processing component 1402 and peripheral interface modules, such as a keyboard, a click wheel, buttons, and the like. The buttons may include, but are not limited to, a home button, a volume button, a starting button, and a locking button.

The sensor component 1414 includes one or more sensors to provide status assessments of various aspects of the electronic device 1400. For instance, the sensor component 1414 may detect an open/closed status of the electronic device 1400, relative positioning of components, e.g., the display and the keypad, of the electronic device 1400, a change in position of the electronic device 1400 or a component of the electronic device 1400, a presence or absence of user contact with the electronic device 1400, an orientation or an acceleration/deceleration of the electronic device 1400, and a change in temperature of the electronic device 1400.

The communication component 1416 is configured to facilitate communication, wired or wirelessly, between the electronic device 1400 and other devices. The electronic device 1400 can access a wireless network based on a communication standard, such as Wi-Fi, 2G, 3G, 4G, 6G, or a combination thereof. In one exemplary embodiment, the communication component 1416 receives a broadcast signal or broadcast associated information from an external broadcast management system via a broadcast channel. In one exemplary embodiment, the communication component 1416 further includes a near field communication (NFC) module to facilitate short-range communications. For example, the NFC module may be implemented based on a radio frequency identity (RFID) technology, an infrared data association (IrDA) technology, an ultra-wideband (UWB) technology, a Bluetooth (BT) technology, and other technologies.

In exemplary embodiments, the electronic device 1400 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer readable storage medium including instructions, such as included in the memory 1404, executable by the processor in the electronic device 1400, for performing the above-described methods. For example, the non-transitory computer-readable storage medium may be a ROM, a RAM, a CD-ROM, a magnetic tape, a floppy disc, an optical data storage device, and the like.

The various device components, modules, components, blocks, or portions may have modular configurations, or are composed of discrete components, but nonetheless can be referred to as "modules" in general. In other words, the "components," "modules," "blocks," "portions," or "units" referred to herein may or may not be in modular forms, and these phrases may be interchangeably used.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a standalone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "/" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

The invention claimed is:

1. A display control method applicable to an electronic device, wherein the electronic device comprises a processor and an active-matrix organic light-emitting diode (AMOLED) display, and the method comprises: obtaining a delay instruction from the processor, wherein the delay instruction comprises a delay duration required to display a current image frame; determining a plurality of control pulses required to display the current image frame according to the delay duration, wherein duty cycles of the plurality of the control pulses are identical; and upon a synchronization signal is received, generating each of the plurality of the control pulses sequentially, wherein the control pulse is configured to control the AMOLED display for dimming and displaying;

wherein the determining the plurality of control pulses required to display the current image frame according to the delay duration comprises: performing a remainder operation on the delay duration with a preset duration to obtain a quotient as a first number of first control pulses whose duration is the preset duration and a remainder as a duration of a second control pulse, wherein a target number of the plurality of control pulses required is determined as a sum of a second number of control pulses corresponding to a refresh period of the AMOLED display, the first number of the first control pulses, and a number of the second control pulse, and the preset duration refers to a fixed duration previously set for the control pulse; and obtaining a duty cycle of each control pulse, wherein the duty cycles of the control pulses are identical.

2. The display control method according to claim 1, wherein the determining the plurality of control pulses required to display the current image frame according to the delay duration comprises:

obtaining a sum of the delay duration and a refresh period of the AMOLED display;

obtaining a plurality of first control pulses and a second control pulse based on the sum and a preset duration, wherein a target number of the plurality of control pulses required is determined based on a number of the first control pulses and a number of the second control pulses, the first control pulse refers to a control pulse whose duration is the preset duration, the second control pulse refers to a control pulse whose duration is shorter than the preset duration, and the preset duration refers to a fixed duration previously set for the control pulse; and obtaining duty cycles of the plurality of first control pulses and the second control pulse, wherein the duty cycles of the plurality of first control pulses and the second control pulse are identical.

3. The display control method according to claim 1, further comprising:

obtaining an image frame to be processed;

obtaining a target duration for processing the image frame; and when the target duration is longer than a preset duration, generating the delay instruction.

4. An electronic device implementing the method of claim 1, comprising:

the processor;

memory storing instructions, wherein the processor is configured to execute the instructions in the memory to implement steps of the method;

the AMOLED display; and a driving circuit comprising a communication circuit, a cache, a processing circuit, and a pulse generator;

wherein the communication circuit is configured to obtain image frame data to be displayed and a delay instruction;

the cache is configured to cache the image frame data;

the processing circuit is configured to determine a plurality of control pulses required to display a current image frame according to a delay duration, wherein the duty cycles of the plurality of the control pulses are identical; and the pulse generator is configured to sequentially generate each of the plurality of the control pulses when receiving a synchronization signal, wherein the control pulse is configured to control the AMOLED display for dimming and displaying.

5. The electronic device of claim 4, wherein the duty cycles of the plurality of the control pulses in a refresh period are controlled to be identical, to thereby ensure that brightness of the AMOLED display remains unchanged and that jittering of displayed images are avoided.

6. A non-transitory computer-readable medium having instructions stored thereon for execution by a processing circuit to implement operations of the method according to claim 1.

7. The non-transitory computer-readable medium according to claim 6, wherein the determining the plurality of control pulses required to display the current image frame according to the delay duration comprises:

obtaining a sum of the delay duration and a refresh period of the AMOLED display;

obtaining a plurality of first control pulses and a second control pulse based on the sum and a preset duration, wherein a target number of the plurality of control pulses required is determined based on a number of the first control pulses and a number of the second control pulses, the first control pulse refers to a control pulse whose duration is the preset duration, the second control pulse refers to a control pulse whose duration is shorter than the preset duration, and the preset duration refers to a fixed duration previously set for the control pulse; and obtaining duty cycles of the plurality of first control pulses and the second control pulse, wherein the duty cycles of the plurality of first control pulses and the second control pulse are identical.

8. The non-transitory computer-readable medium according to claim 6, wherein the instructions further comprise:

obtaining an image frame to be processed;

obtaining a target duration for processing the image frame; and when the target duration is longer than a preset duration, generating the delay instruction.

9. A driving circuit applicable to an electronic device having an active-matrix organic light-emitting diode (AMOLED) display, wherein the driving circuit comprises a communication circuit, a cache, a processing circuit, and a pulse generator, the communication circuit is configured to obtain image frame data to be displayed and a delay instruction; the cache is configured to cache the image frame data; the processing circuit is configured to determine a plurality of control pulses required to display a current image frame according to a delay duration, wherein duty cycles of the plurality of the control pulses are identical; and the pulse generator is configured to sequentially generate each of the plurality of the control pulses when receiving a synchronization signal, wherein the control pulse is configured to control the AMOLED display for dimming and displaying;

wherein the processing circuit is configured to determine the plurality of control pulses required to display the current image frame according to the delay duration by: performing a remainder operation on the delay duration with a preset duration to obtain a quotient as a first number of first control pulses whose duration is the preset duration and a remainder as a duration of a second control pulse, wherein a target number of the plurality of control pulses required is determined as a sum of a second number of control pulses corresponding to a refresh period of the AMOLED display, the first number of the first control pulses, and a number of the second control pulse, while the preset duration refers to a fixed duration previously set for the control pulse; and obtaining a duty cycle of each control pulse, wherein the duty cycles of the control pulses are identical.

10. The driving circuit according to claim 9, wherein the processing circuit is configured to determine the plurality of control pulses required to display the current image frame according to the delay duration by:

obtaining a sum time of the delay duration and a refresh period of the AMOLED display;

obtaining a plurality of first control pulses and a second control pulse based on the sum time and a preset duration, wherein a target number of the plurality of control pulses required is determined based on a number of the first control pulses and a number of the second control pulse, while the first control pulse refers to a control pulse whose duration is the preset duration, the second control pulse refers to a control pulse whose duration is shorter than the preset duration, and the preset duration refers to a fixed duration previously set for the control pulse;

obtaining duty cycles of the plurality of first control pulses and the second control pulse, wherein the duty cycles of the plurality of first control pulses and the second control pulse are identical.

11. An electronic device, comprising: a processor; memory storing instructions, wherein the processor is configured to execute the instructions in the memory to: obtain an image frame to be processed; obtain a target duration for processing the image frame; and when the target duration is longer than a preset duration, generate a delay instruction; an active-matrix organic light-emitting diode (AMOLED) display; and a driving circuit comprising a communication circuit, a cache, a processing circuit, and a pulse generator; wherein the communication circuit is configured to obtain image frame data to be displayed and a delay instruction; the cache is configured to cache the image frame data; the processor is configured to determine a plurality of control pulses required to display a current image frame according to a delay duration, wherein the duty cycles of the plurality of the control pulses are identical; and the pulse generator is configured to sequentially generate each of the plurality of the control pulses when receiving a synchronization signal, wherein the control pulse is configured to control the AMOLED display for dimming and displaying;

wherein the processing circuit is configured to determine the plurality of control pulses required to display the current image frame according to the delay duration by: performing a remainder operation on the delay duration with a preset duration to obtain a quotient as a first number of first control pulses whose duration is the preset duration and a remainder as a duration of a second control pulse, wherein a target number of the plurality of control pulses required is determined as a sum of a second number of control pulses corresponding to a refresh period of the AMOLED display, the first number of the first control pulses, and a number of the second control pulse, and the preset duration refers to a fixed duration previously set for the control pulse; and obtaining a duty cycle of each control pulse, wherein the duty cycles of the control pulses are identical.

12. The electronic device according to claim 11, wherein the processing circuit is configured to determine the plurality of control pulses required to display the current image frame according to the delay duration by:

obtaining a sum time of the delay duration and a refresh period of the AMOLED display;

obtaining a plurality of first control pulses and a second control pulse based on the sum time and a preset duration, wherein a target number of the plurality of control pulses required is determined based on a number of the first control pulses and a number of the second control pulse, while the first control pulse refers to a control pulse whose duration is the preset duration, the second control pulse refers to a control pulse whose duration is shorter than the preset duration, and the preset duration refers to a fixed duration previously set for the control pulse;

obtaining duty cycles of the plurality of first control pulses and the second control pulse, wherein the duty cycles of the plurality of first control pulses and the second control pulse are identical.

* * * * *